US007980502B2

(12) United States Patent
Doppstadt et al.

(10) Patent No.: US 7,980,502 B2
(45) Date of Patent: Jul. 19, 2011

(54) CUTTING TOOL FOR COMMINUTING DEVICES

(75) Inventors: Johann Doppstadt, Velbert (DE); Horst Berger, Calbe (DE)

(73) Assignee: Doppstadt Calbe GmbH, Calbe (DE)

( * ) Notice: Subject to any disclaimer, the term of this patent is extended or adjusted under 35 U.S.C. 154(b) by 216 days.

(21) Appl. No.: 12/083,963

(22) PCT Filed: Oct. 23, 2006

(86) PCT No.: PCT/EP2006/010193

§ 371 (c)(1),
(2), (4) Date: Apr. 23, 2008

(87) PCT Pub. No.: WO2007/045508

PCT Pub. Date: Apr. 26, 2007

(65) Prior Publication Data

US 2009/0140091 A1 Jun. 4, 2009

(30) Foreign Application Priority Data

Oct. 23, 2005 (DE) ..... 20 2005 016 672 U

(51) Int. Cl.
*B02C 18/18* (2006.01)

(52) U.S. Cl. ..... 241/294

(58) Field of Classification Search ..... 241/242, 241/243, 294

See application file for complete search history.

(56) References Cited

U.S. PATENT DOCUMENTS

| | | | | |
|---|---|---|---|---|
| 1,714,098 | A * | 5/1929 | Miller | 407/36 |
| 1,756,986 | A * | 5/1930 | Miller | 407/44 |
| 4,106,708 | A * | 8/1978 | Kropa | 241/222 |
| 5,100,070 | A * | 3/1992 | Montgomery, Sr. | 241/294 |
| 5,873,534 | A | 2/1999 | Shinn | |
| 7,293,729 | B2 * | 11/2007 | Ragnarsson | 241/197 |
| 2005/0116074 | A1 | 6/2005 | Kusak | |

FOREIGN PATENT DOCUMENTS

| | | |
|---|---|---|
| DE | 203 13 116 | 12/2004 |
| DE | 20 2005 010 337 | 2/2006 |
| EP | 0 908 238 | 4/2003 |
| EP | 1 362 639 | 11/2003 |

OTHER PUBLICATIONS

International Search Report dated Feb. 2, 2006.
German Search Report dated Oct. 12, 2006.

* cited by examiner

*Primary Examiner* — Mark Rosenbaum
(74) *Attorney, Agent, or Firm* — Jacobson Holman PLLC

(57) ABSTRACT

The invention refers to a cutting tool for comminution devices, comprising a knife (2) or knife edge which can be fastened to a comminution cylinder or a toothed body (1). The invention is characterized in that the knife (2) can be arranged non-positive and positive interlocking at the comminution cylinder or the toothed body (1).

13 Claims, 7 Drawing Sheets

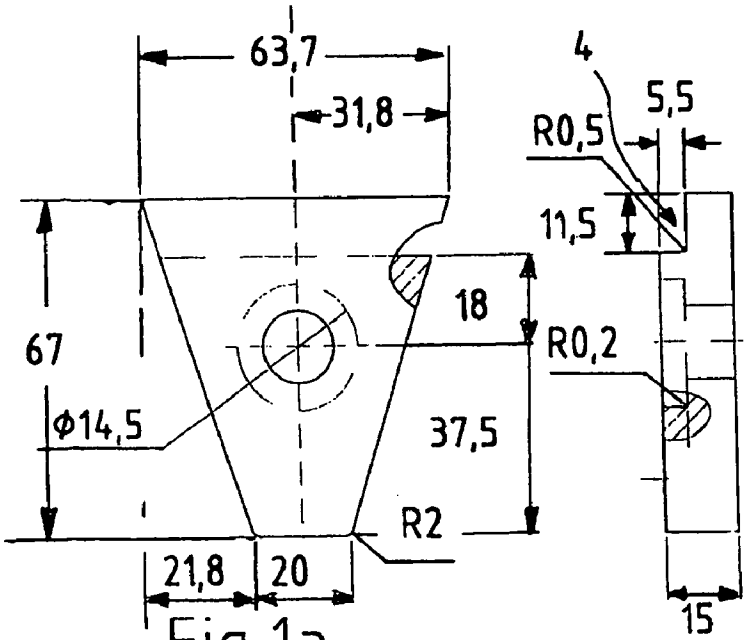
Fig.1a
Fig.1b
Fig.1c
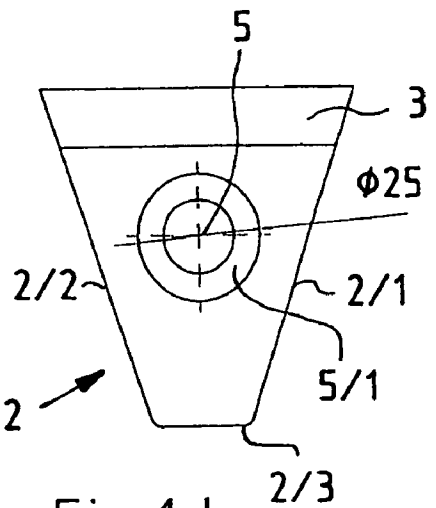
Fig.1d
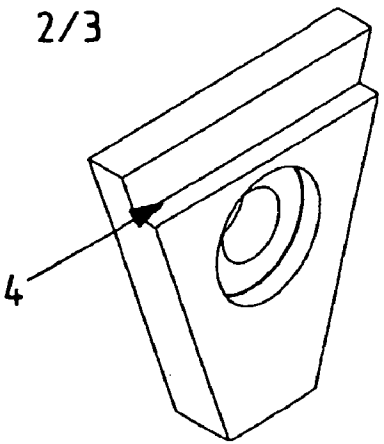
Fig.1e

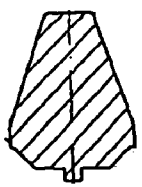
Fig.5f
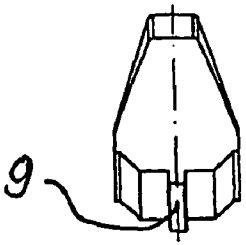
Fig.5e
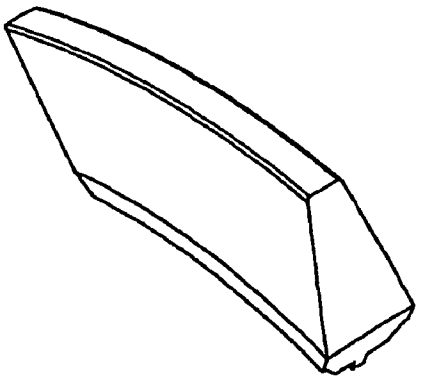
Fig.5d
Fig.5b
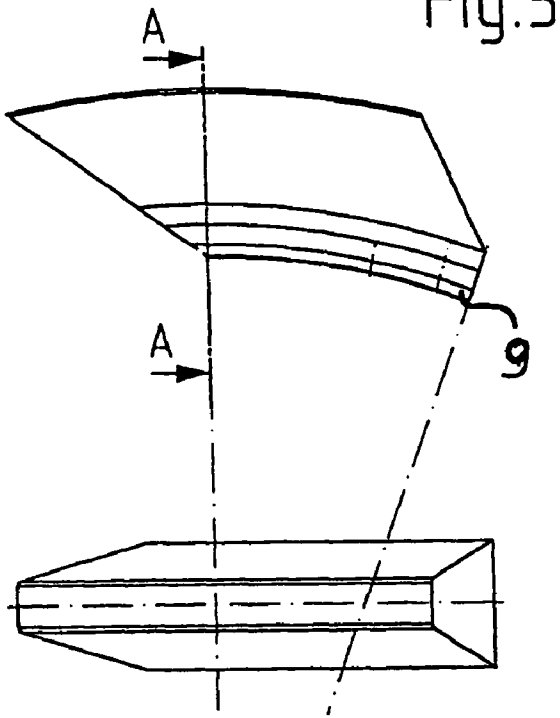
Fig.5c
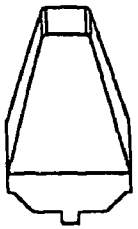
Fig.5a

CUTTING TOOL FOR COMMINUTING DEVICES

This is a national stage of PCT/EP2006/010193 filed Oct. 23, 2006 and published in German.

FIELD OF THE INVENTION

The invention refers to a cutting tool for comminution devices, comprising a knife or knife edge which can be fixed on a comminution cylinder or a toothed body.

BACKGROUND OF THE INVENTION

Cutting tools of this kind are known. These cutting tools are also referred to as knives, and can be fixed on or at a comminution cylinder, or on or at a toothed body. The comminution cylinder inclusively the toothed bodies fixed to it can be caused to move rotationally. For comminution the cutting tools interact with counter cutting edges which are arranged in such a way that a comminution of the materials to be comminuted or the stuff to be comminuted is possible without any problems. The cutting edge or the counter cutting edge is here arranged and designed in such a way that the shapes of knife and cutting edge are designed correspondingly to each other, a certain gap being set which determines the desired size of the material to be comminuted.

As known shapes of knives here angular or angled shapes are known. Here, for example, square or triangle forms are possible. Also the use of circular forms or knife forms deviating slightly from the circular form is known. The wear of knifes here is enormous so that a frequent change of the knives is necessary. The problem with the known knife shapes is that they mostly are only designed on one side of the cutting tool as cutting edge itself. The wear here is even higher. It is now possible, for example to turn triangle or square knives after one cutting edge is worn so that a multiple use may be provided. For the fine comminution of corresponding materials, however, this embodiment is not suited so that here turning the cutting tools is not successful. The problem is therefore that, with a frequent change the effort for exchanging the knives or the knife carriers is extraordinarily high. As there is also a quite high wear of the knife carriers, for example caused by undesired materials in the material to be comminuted which get in the comminution device, these may be metal waste, the cutting edges and also the toothed bodies can be damaged. Then the effort for exchanging the cutting edges and the toothed bodies is much more higher.

It is therefore an object of the invention to provide a solution which allows a simple change of knives and toothed bodies.

SUMMARY OF THE INVENTION

The invention comes from the state of the art described before, and suggests for solving the problem a cutting tool for comminution devices, comprising a knife or knife edge which can be fixed on a comminution cylinder or a toothed body which is characterised in that the knife can be arranged positive and non-positive interlocking at the comminution cylinder or the toothed body. By means of this solution according to the invention the change of the knives is made much more easier so that with a normal wear a quite simple change can be carried out at the toothed bodies. The arrangement by means of a positive and non-positive interlocking has also the advantage that the support of the knife edge at the toothed body itself is solved in a convenient way because there forces can be received or deducted accordingly. For that purpose in particular the combination of a positive and non-positive fastening to the toothed body is advantageous. A suitable shaping of the cutting tool also leads to an improvement of the cutting performance and, in particular, to a stability of the knife edges themselves. This is actually a considerable advantage with comminution tasks in so-called fine comminution devices.

A development of the invention suggests that the knife can be placed upon, slipped on and/or fastened to the toothed body. Here even other modifications beside the before-mentioned ones are possible which will lead to a further improvement of the ease of servicing of the comminution device altogether.

According to a development of the invention the knife is attached fixedly releasable to the comminution cylinder or toothed body. This modification also leads to a further improvement of the speed of change of the cutting tools in the comminution device itself. By means of the usual fastening means, for example screw connections, the knife can be fastened to the comminution cylinder or the toothed body quite easily and simply, and in the case of service also be released again. The adjustment of the changed knife or knives is relatively easy as by the fastening means a suitable centering is already provided.

According to a development the invention is therefore characterised in that the knife is fastened to the comminution cylinder or the toothed body with a screw connection. The cutting tool or the knife according to the invention is provided in particular for the use in fine comminution devices. Because of its design and embodiment it is in particular suited for this use. For rougher comminution works or pre-comminution works the knives suggested in the invention are not or only limited suited.

A development of the invention provides a knife seat in which at least a part of the knife can be placed upon or at the comminution cylinder or the toothed body.

The invention is also characterised by the fact that the knife seat is provided in opposite direction to the cutting direction in assembled position at the bottom of the knife. Of course, also the modifications are comprised according to the invention where this knife seat is not provided or where the knife seat is formed by the bottom edge of the knife body itself on the toothed body.

A modification of the invention provides that the knife seat is designed as recess, countersinking or the like. In this way very precise and economical knife seats can be produced. Seen from the side one of the shapes of the knife seat has preferably the shape of a square.

The cutting tool is, according to a preferred modification of the invention, characterised by the fact that the knife is shaped trapezoid. This embodiment is suited in particular for carrying out cutting work, in particular fine comminution work. These knives have a high cutting performance and endurance. The wear is less than with the solutions known from the state of the art.

According to another embodiment the knife is designed trapezoid, and at least the lateral edges of the trapezoid as well as its upper edge, seen in the direction of cutting, form the cutting edges of the cutting tool. This modification of the invention is preferred as with that optimal results in fine comminution may be provided. Cutting tools of this kind do not wear so fast, and, in connection with the convenient change, it is actually possible to change knives of this kind and to sharpen them accordingly so that they, for example, may be set in anew.

The knife bodies are, according to a development of the invention, designed plate-like, and the edges in the direction of the plate depth form here a right angle. However, the invention is not limited to a right angle. Rather, the knife body is, according to another embodiment of the invention, designed plate-like, and the edges in the direction of the plate depth form an angle differing from 90°, in particular a sharp angle. This even enhances the cutting performance in some cases.

The knife has preferably in the center of the plate-like body a boring for holding a fastening means, for example a pan head screw or the like. Of course, also fastening with other fastening means is possible. Thus it is, for example, provided to use bolt-like fastening means which are guided in a sleeve centering the knife.

Another aspect is given by the fact that the knife has a shape corresponding to the toothed body. Thus it is provided that a support or contact of the knife almost all-over of or with the toothed body is given. The knife has here at least in the direction of cutting exterior dimensions which are slightly larger than those of the toothed body in order to reach a so-called drop cut.

The cutting tool according to the invention is, according to a development, formed of steel, in particular hardened tool steel. For corresponding comminution tasks it has been found that steel or tool steel is preferred. Other materials which are accordingly suited are, however, also comprised by the invention.

The cutting tool as described before is characterised, according to a development of the invention, in that the knife or the knife body has a width at the bottom between 50 mm and 70 mm, a height between 50 mm and 80 mm, and a width at the upper cutting edge between 15 mm and 30 mm. A preferred modification of the invention is characterised by the fact that the knife or the knife body has a preferred width at the bottom of 63.7 mm, at the top a width of 20 mm and a height of 67 mm. These dimensions are in particular suited for the fine comminution works already described several times, which can be carried out by means of the cutting tool according to the invention. The cutting tool has, according to the invention, a wall thickness of 10 mm to 30 mm, preferably in two modifications 15 mm and 20 mm. Thus it has a sufficient thickness in order to receive the concussions connected with the comminution process, and to guarantee quite a long service life.

The boring in the cutting tool is, according to a development of the invention, characterised in that it has a diameter of 10 mm to 20 mm, preferably of 14.5 mm. The centering boring for a sleeve centering the knife has, according to the invention, a diameter between 50 mm and 30 mm, preferably 25 mm. The sleeve may serve here, for example, for passing through a fastening screw. It then centers the knife accordingly, for example, when boring and sleeve are designed as fit. It is, of course, also provided, according to the invention, to use instead of a screw a bolt, for example a clamping bolt.

According to a development of the invention the boring is arranged with a distance of 15 mm to 25 mm from the upper edge of the knife seat in the direction of the upper cutting edge. From the upper cutting edge, seen in the direction of the knife seat, this measure is preferably 37.5 mm.

A development of the invention is characterised in that the centering boring is designed as fit. By means of this fit form a very precise centering of the knife is achieved which is very important in particular with fine comminution. Because of the fit the knives sit arranged exactly centrically, and are arranged in particular corresponding to the counter cutting edges so that the knives and the counter cutting edges then do not have to be aligned to each other separately.

The invention also refers to a comminution device, in particular a fine comminution device with a cutting tool according to one or more of the preceding embodiments and modifications of the invention. The comminution device according to the invention is provided with a rotating designed comminution cylinder which has preferably at least one knife holding device or toothed body, and has at least one counter cutting edge which is able to interact with the cutting tool. The comminution device is characterised in that the toothed body, the knife and the counter cutting edge have trapezoid shape in such a way that the knife interacts for comminution with the counter cutting edge. The comminution device designed in this way is characterised by a high cutting performance, high endurance of the knives themselves and by a graining as precise as possible of the comminuted material.

Another aspect of the comminution device according to the invention is given by the fact that the toothed body is designed smaller in the direction against the direction of cutting than the knife at the cutting edges. By means of that the already described effect of free cutting occurs as it has been described already for the cutting tool according to the invention.

A comminution device as described before is characterised according to a development of the invention by the fact that the counter knife has at least at the narrower edge of the trapezoid radius at the corners.

The toothed body or the knife carrier are arranged, according to the invention, preferably spiral at the circumference of the comminution cylinder. The result is a uniform load during the cutting process. Load peaks and jamming are prevented as far as possible.

A modification of the invention is characterised in that the toothed body has on the side facing the comminution cylinder a guide spring by means of which the toothed body is guided and, if necessary, fixed on the comminution cylinder in a correspondingly designed groove.

A particularly convenient modification of the invention is characterised in that the toothed body has at least one fixing boring through which fastening means for the releasable fastening to the comminution cylinder can pass. It is now possible, if necessary, to exchange damaged toothed bodies completely without having to dismantle the entire cylinder. Rather a suitable toothed body can be substituted by another. Furthermore, it is also possible to use toothed bodies with different cutting edges for different cutting tasks or comminution processes. For that purpose then the toothed bodies with suitable cutting edges have to be changed. The modification described last is thus characterised by a very high ease of servicing. Knives at the toothed body can be changed without any problems as well as the toothed body itself at the comminution cylinder.

Another convenient embodiment of the invention is given by the fact that the toothed body is designed in several parts, in particular in two parts. Here the part of the toothed body which lies in the back seen in the direction of cutting is provided as supporting body for the part arranged in front of it. It is here in particular preferred that the first part is exchangeable, and the second part is attached fixedly to the comminution cylinder.

BRIEF DESCRIPTION OF THE DRAWINGS

In the following the invention is described further by means of examples.

In the figures:

FIGS. 1*a* to 1*e* different views of the cutting tool according to the invention, FIGS. 2*a* to 2*c* counter cutting edge for a comminution device according to the invention, FIG. 3 three-dimensional illustration of an open comminution device according to the invention, FIG. 4 comminution cylinder with exchangeable toothed bodies according to the invention, FIGS. 5*a* to 5*f* modification for a support for a toothed body according to the invention, FIGS. 6*a* to 6*f* exchangeable toothed body according to the invention, FIGS. 7*a* to 7*e* another embodiment of a cutting tool according to the invention.

DETAILED DESCRIPTION OF THE PREFERRED EMBODIMENTS

Figure 2C:
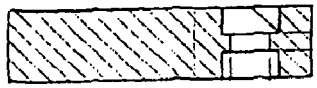

FIGS. 1*a* to 1*e* show different views of a cutting tool according to the invention. FIG. 1*a* shows here a back view of a cutting tool in an embodiment where it can be seen that here the preferred trapezoid shape has been chosen for the cutting tool. With regard to the reference numbers it is referred to FIGS. 1*d* and 1*e* where all important characteristics for the cutting tool according to the invention can be seen. Reference number 2 indicates the knife. As it refers here to the knife altogether it is indicated by an arrow. The three sides of the trapezoid 2/1, 2/2 and 2/3 form the cutting edges for comminuting the material to be comminuted. These cutting edges interact with a counter cutting edge which will be shown in FIG. 2. The knife seat 3 is at the bottom end of the cutting tool 2. Thus it is clear that for better illustration, in particular of the three-dimensional drawing according to FIG. 1*e*, the cutting tool is shown upside down. The knife seat 3 is on the side opposite the direction of cutting. However, this only refers to the embodiment having such a knife seat 3. Reference number 4 in FIG. 1*e* indicates here that the knife seat 3 is designed as recess 4, countersinking or the like. Also on the side opposite the cutting direction there is the centering boring 5/1 extending around the boring 5. The centering boring 5/1 is provided for a sleeve centering the knife having a diameter between 15 mm and 30 mm, preferably 25 mm. This sleeve is not shown in the drawing. The knife is designed plate-like and has a wall thickness of up to 30 mm. In the shown embodiment a wall thickness of 15 mm has been chosen. The cutting tool or knife 2 has a width between 50 mm and 70 mm, and a height between 50 mm and 80 mm. It has at the upper cutting edge 2/3 a size between 15 mm and 30 mm. The dimensions shown in the drawing are preferred measures. However, the invention is not limited to them.

Figure 2A:
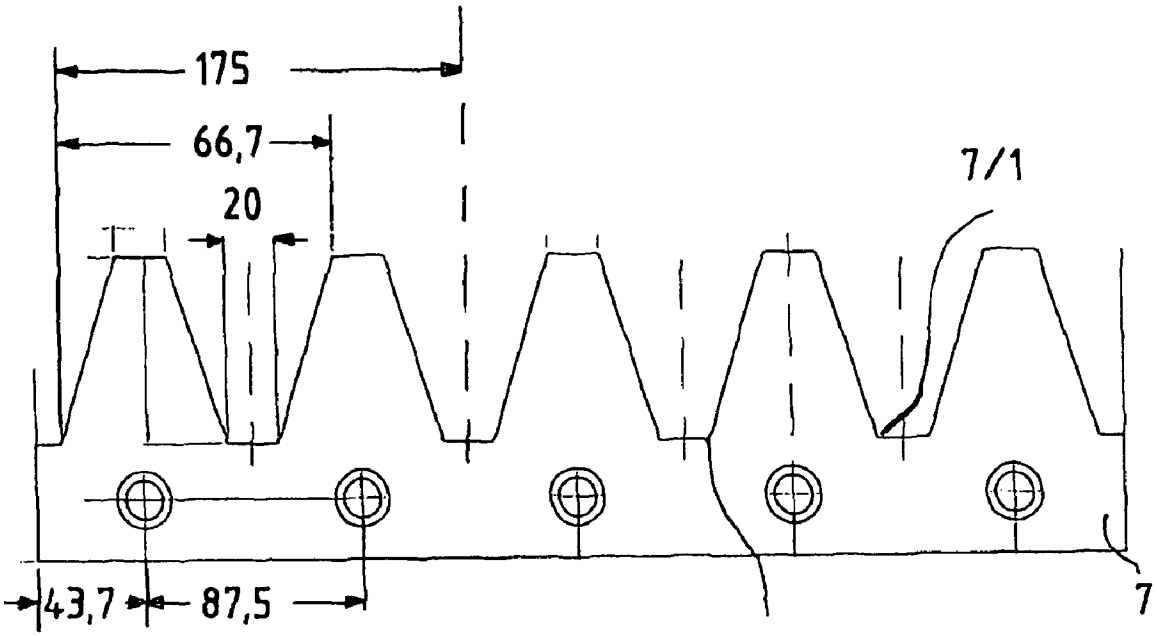
Figure 2B:
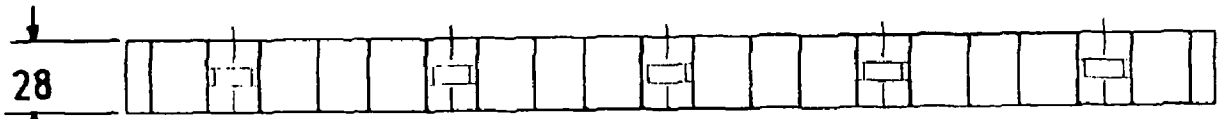

FIGS. 2*a* to 2*c* show a counter cutting edge for a comminution device according to the invention. As it can be discerned the counter cutting edge is designed in such a way that it is formed correspondingly with the cutting tool according to the invention, and is able to interact with it for comminuting the material to be reduced. FIG. 2*a* makes it easy to recognise that here also the trapezoid has been chosen in order to be able to carry out comminution tasks, in particular fine comminution tasks. The counter knife 7 has at least at the narrower side of the trapezoid at the corners radius 7/1 and 7/2. Of course, also at the upper, wider sides of the trapezoid radius may be provided. The dimensions given in FIGS. 2*a* and 2*b* are only a preferred modification. The invention, however, is not restricted to it.

Figure 3:
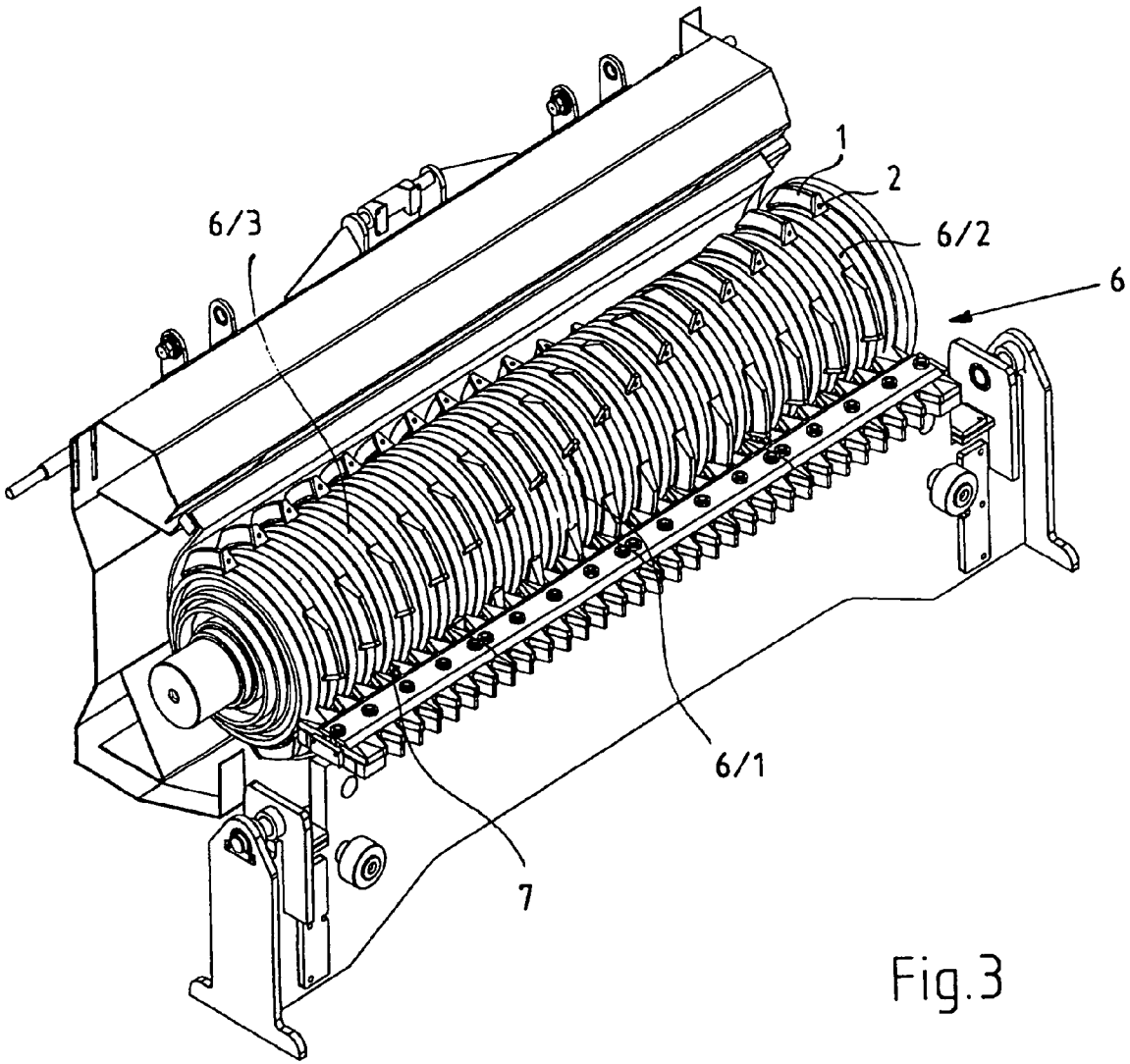

FIG. 3 shows a three-dimensional illustration of an open comminution device according to the invention. In this illustration are the toothed bodies 1 arranged on the comminution cylinder 6 shown for the first time. In the direction of cutting at the toothed bodies 1 the knives 2 are arranged non-positive and positive interlocking. The toothed bodies themselves are fastened in a groove 6/1 on cylinder sections 6/2 or 6/3. The toothed bodies 1 can be here fastened fixedly to the cylinder 6. However, it is also possible, to fasten the toothed bodies 1 releasable-fixedly to the cylinder 6. This can be achieved, for example, by screw or clamping connections, which will be described in later embodiments. The counter knife 7 is at the stand of the comminution device. It can be seen in the illustration that the comminution device shown only partly in FIG. 3 has two cylinders, only one of them being shown. The counter cutting edge 7, however, can already be seen designed for two cylinders 6. These cylinders run preferably in opposed directions in order to guarantee an optimal comminution.

Figure 4:
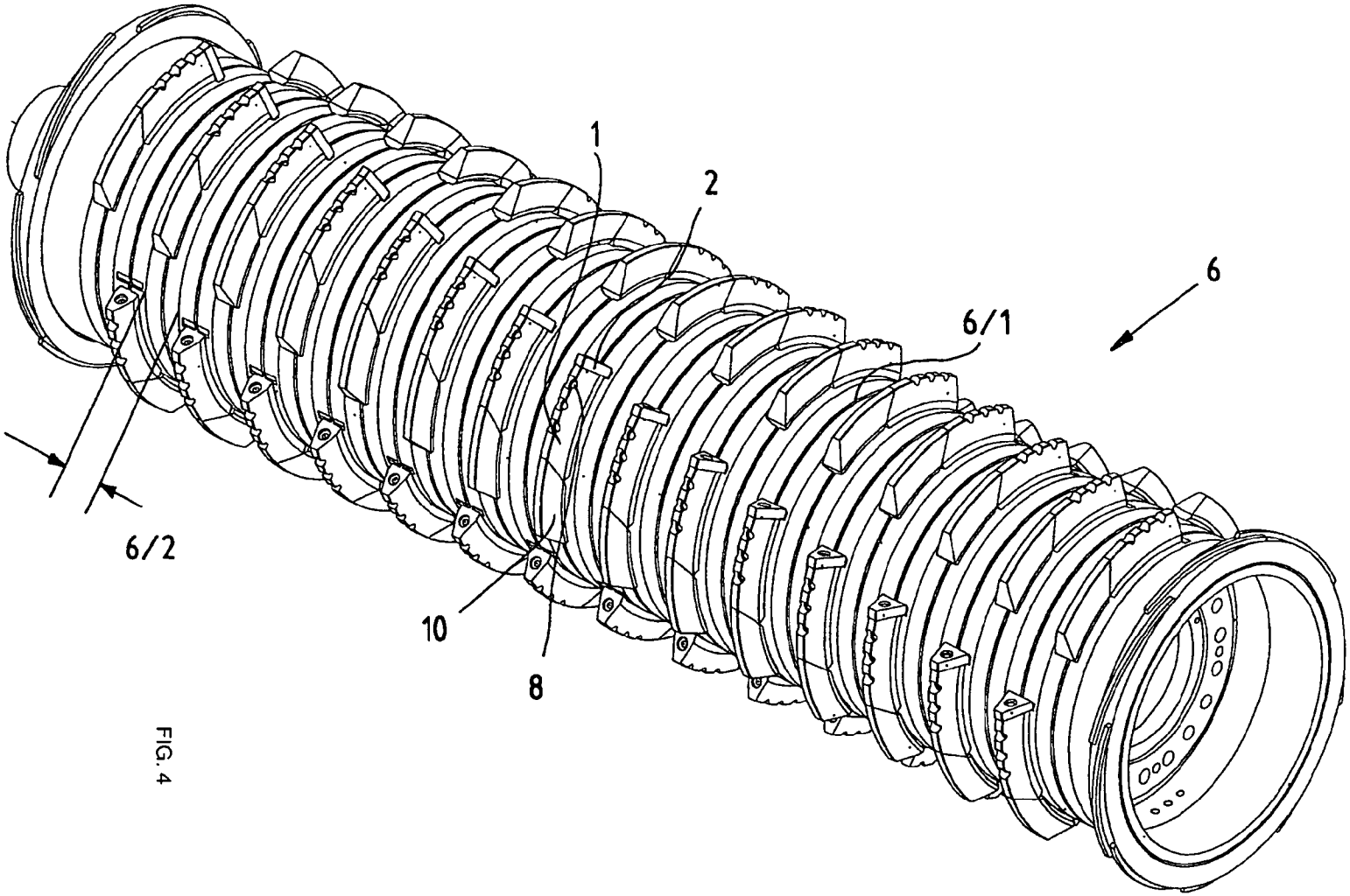
Figure 6C:
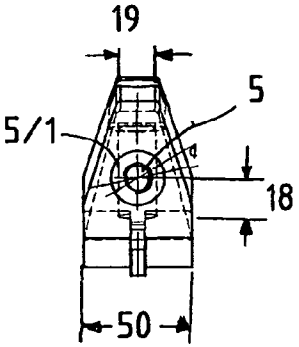
Figure 6F:
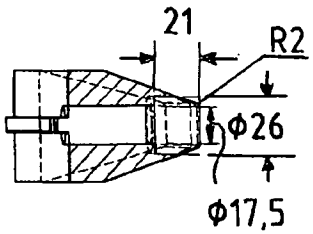
Figure 6B:
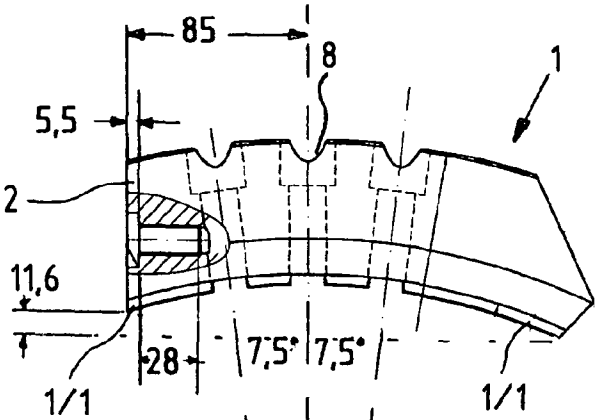
Figure 6D:
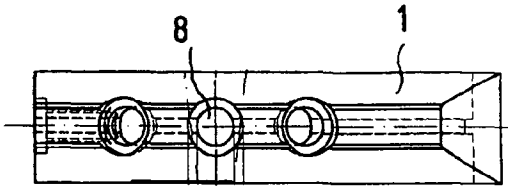
Figure 6A:
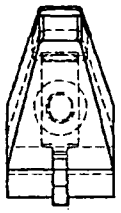
Figure 6E:
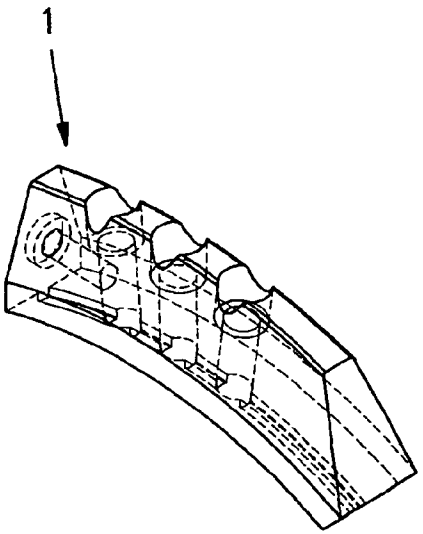
Figures 7A, 7B, 7C, 7D, 7E:
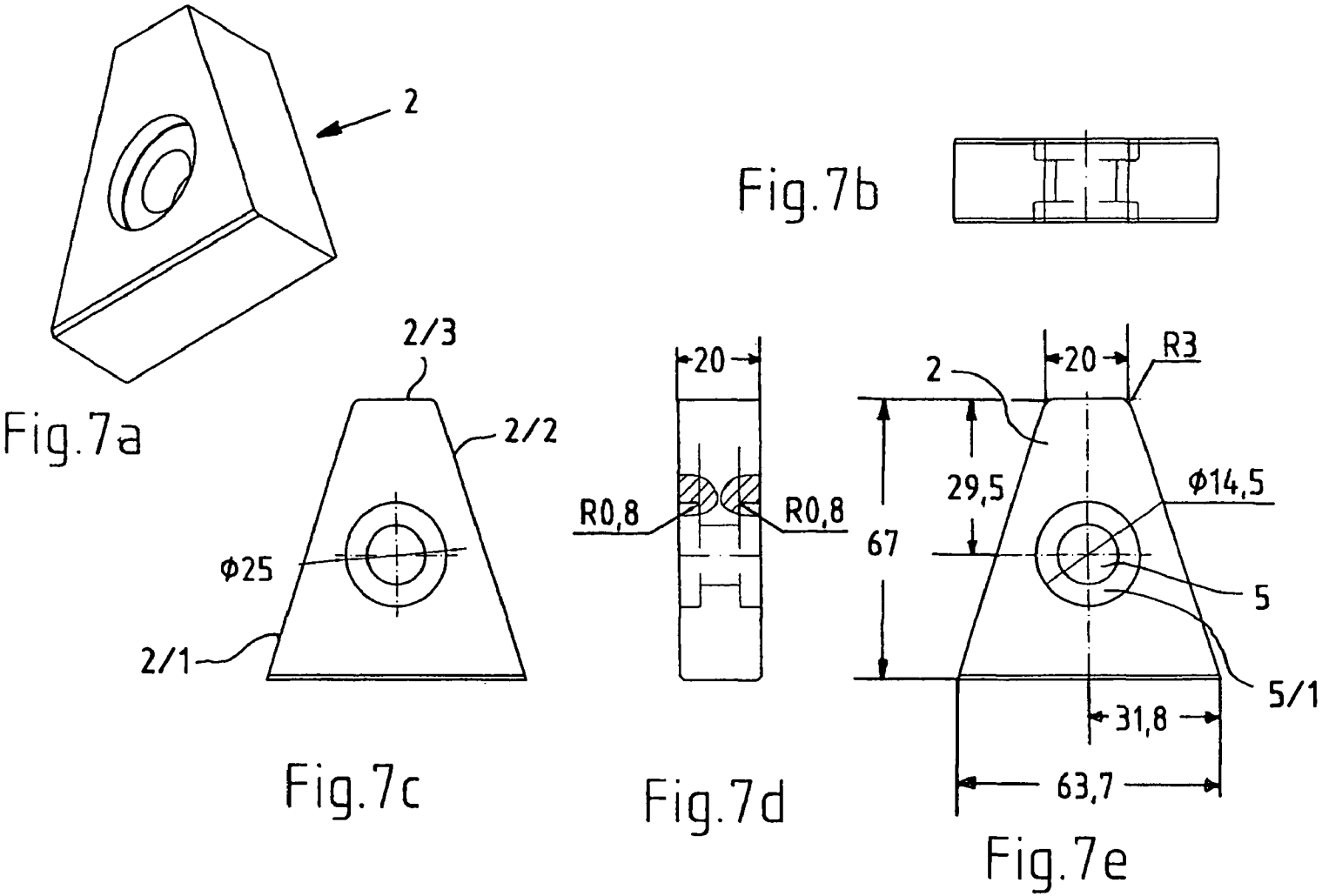

FIG. 4 shows a comminution cylinder with exchangeable toothed bodies 1 according to the invention. The toothed bodies 1 are here formed of two parts 1 and 10, toothed body 1 being provided with fixing borings 8 which take care that this part of the toothed body can be attached to the cylinder 6. It can be, however, also by this modification be released very simply. The second part of the toothed body 10 is, according to the modification in FIG. 4, provided as supporting body supporting the first part of the toothed body 1. It is located here, seen in the direction of rotation, behind the first toothed body part 1. Reference number 2 shows again the knife which is at the toothed body 1. For guiding and fixing the toothed body 1 or 10 on the cylinder a groove 6/1 is provided on the cylinder in which the toothed body 1 or the second part of the toothed body 10 can be guided. If they are positioned and aligned there, for example, the second part of the toothed body 10 can be welded with the cylinder, for example, while the first part of the toothed body 1 is fixed to the cylinder by means of screw connections. The advantage with this modification is clear as here at least the first, more worn part of the toothed body can be exchanged in quite a simple way. It is possible very fast to change, to position or align without any problems the suitable toothed bodies with the respective knives for different comminution tasks. A single exchange of a knife is also possible, as it has been described already with previous modifications. The cylinder 6 is designed as cylinder so that for comminution cylinders it has a relatively low weight. It is, of course, also possible, to fit the parts of the comminution cylinder 6, shown here as cylinder section 6/2, 6/3, segment-like in the shape of single cylinder segments to one another.

FIGS. 5*a*-5*f* show different views of the supporting body for the toothed body. Spring 8 can be seen provided for centering on the cylinder. The bevellings provided laterally on the side facing the cylinder serve, for example, for welding or attaching a covered welding seam.

FIGS. 6*a* to 6*f* show a modification of a toothed body 1 which can be connected releasable with the comminution cylinder 6. In the modification shown three fixing borings 8 are provided through which fastening means can pass in order to attach the toothed body 1 to the cylinder. On the side facing the cylinder 6 springs 1/1 are arranged which can be guided in the correspondingly shaped groove 6/1 at the comminution cylinder. Thus a simple and reliable alignment of the toothed body 1 on the cylinder 6 is guaranteed. The modification shown in FIGS. 6*a* to 6*e* is characterised by a high universality. The comminution device according to the invention becomes essentially easier to serve altogether. Furthermore it can also be re-fitted without effort and in time for different comminution tasks.

FIGS. 7*a* to 7*e* show a modification of a knife 2 which is designed stronger than the knife shown in FIG. 1. The wall thickness is here 20 mm. It may have even up to 30 mm for certain tasks. This modification does not have a knife seat. It rather is supported by the cylinder 6 or the toothed body 1 on its bottom side. The modification of a knife 2 shown in FIG. 7 is also characterised in that it is provided on both sides with suitable centering borings 5/1. Thus it is provided that, on the one hand, the centering boring serves for holding a sleeve centering the knife; on the other hand, then, for example, a pan head screw can be used for attaching the knife. It is also provided that this knife can be used on both sides. The dimensions given in all figures are preferred embodiments. However, the invention is not restricted to these dimensions. In the description and the claims there are rather given tolerances which are at least also comprised by the invention.

The invention has been described before by means of examples. The claims filed now and to be filed later on with the description are attempted formulations without prejudice for obtaining a broader protection.

References in the sub-claims relate to the further design of the subject matter of the main claim through the characteristics of the respective sub-claim. These are, however, not to be understood as a waiver of independent protection of the matter for the characteristics of the referred sub-claims.

Characteristics only disclosed in the description so far may now, in the course of proceedings, be claimed as being of inventive relevance, for example to distinguish from the state of the art.

The invention claimed is:

1. Cutting tool for comminution devices, said cutting tool comprising a rotatably supported comminution cylinder, a toothed body for arrangement at and being removably secured to the comminution cylinder, a knife arranged on said toothed body, the knife being interlocked with the toothed body, and a knife seat defined by one of a recess and a countersinking, the one of the recess and the countersinking being an integral part of a bottom portion of the knife with the knife seat being located within the comminution cylinder while the knife is attached to the toothed body.

2. The cutting tool according to claim 1, wherein the knife is attached fixedly releasable to the toothed body.

3. The cutting tool according to claim 1, wherein the cutting tool is provided for use in fine comminution devices.

4. The cutting tool according to claim 1, wherein the knife seat is provided in an opposite direction to a direction of cutting.

5. The cutting tool according to claim 1, wherein the knife seat, seen from a side, has a shape of a rectangle.

6. The cutting tool according to claim 1, wherein the knife is designed as a trapezoid and at least a side edge of the trapezoid as well as a top edge form cutting edges or are designed as cutting edges in a direction of cutting.

7. The cutting tool according to claim 1, wherein the knife includes a knife body formed in a plate and edges form a right angle in a direction of a depth of the plate.

8. The cutting tool according to claim 1, wherein the knife includes a knife body formed in a plate and edges form in a direction of a depth of the plate an angle differing from 90°.

9. The cutting tool according to claim 1, wherein the knife has a boring in a center of the knife for holding a fastener and the knife is formed of steel.

10. The cutting tool according to claim 1, wherein the knife or a knife body has a width at a bottom of 50 mm to 70 mm, a height of 50 mm to 80 mm, and at an upper cutting edge a width between 15 mm and 30 mm.

11. The cutting tool according to claim 1, wherein the knife or a knife body has at a bottom a width of 63.70 mm, a width at a top of 20.00 mm and a height of 67.00 mm and a wall thickness of 10 to 30 mm.

12. The cutting tool according to claim 1 wherein the knife has a boring with a diameter of 10 mm to 20 mm and a centering boring for a sleeve centering the knife has a diameter between 15 mm and 30 mm.

13. The cutting tool according to claim 1, wherein the knife has a boring and a centering boring.

* * * * *